United States Patent [19]

Tada

[11] Patent Number: 4,492,320

[45] Date of Patent: Jan. 8, 1985

[54] DISPENSER WITH AN AIR PUMP MECHANISM

[75] Inventor: Tetsuya Tada, Tokyo, Japan

[73] Assignee: Canyon Corporation, Tokyo, Japan

[21] Appl. No.: 416,305

[22] Filed: Sep. 9, 1982

[30] Foreign Application Priority Data

Sep. 17, 1981 [JP] Japan ..... 56-137795[U]

[51] Int. Cl.[3] ..... B65D 83/14

[52] U.S. Cl. ..... 222/398; 222/401; 417/440

[58] Field of Search ..... 222/394, 397, 398, 401, 222/402; 239/124, 357, 359, 360, 373, 355; 417/440, 443, 444, 445

[56] References Cited

U.S. PATENT DOCUMENTS 1,745,024 1/1930 Malone .
3,955,720 5/1976 Malone ..... 222/397 X
4,165,025 8/1979 Mascia et al. ..... 222/401

FOREIGN PATENT DOCUMENTS 0037035 10/1981 European Pat. Off. .
725121 5/1932 France .

*Primary Examiner*—Joseph J. Rolla
*Assistant Examiner*—George Pyryt
*Attorney, Agent, or Firm*—Frishauf, Holtz, Goodman & Woodward

[57] ABSTRACT

A cylinder extends into a container containing fluid to be dispensed and includes a pressure accumulating valve at the internal end. A piston sliding in the cylinder includes an air suction valve at the internal end and a pressure chamber is formed between the piston and the cylinder. An elastic piece is axially flexible and is attached to the bottom of the piston. The air suction valve has an axially flexible valve body. A stem fixed at one end to the bottom of the elastic piece is extended into the piston at the other end, and has a pushing part at the other end to release the air suction valve from the valve seat by contacting the valve body when the elastic piece is moved toward the air suction valve.

6 Claims, 5 Drawing Figures

DISPENSER WITH AN AIR PUMP MECHANISM

BACKGROUND OF THE INVENTION

This invention relates to a dispenser with an air pump mechanism which dispenses fluid using compressed air stored previously in a container.

A dispenser with an air pump mechanism which stores compressed air in a container by sliding a piston in a cylinder is well-known. In the known dispenser, a nozzle is moved downwards, not for pump operation, but only for opening a valve. When the nozzle comes down, liquid in the container is pressurized by compressed air and is continuously dispensed through the valve. During a dispensing operation the piston must be locked to reduce the projection from the dispenser as much as possible at the position where it is fully pushed in. However, a large force is required for locking because it is necessary for the piston to be pushed in against compressed air remaining in the cylinder. To remove such a defect, an air hole is adopted in a conventional method. The air hole is closed during pump operation and opened after the pump stops in order to release compressed air remaining in the cylinder into the atmosphere. By this arrangement, the resisting force against the piston locking is removed. However, this construction having such an air hole has the disadvantage of complicated pump operation because not only must the air hole be closed during pump operation, but also closure of the air hole must be maintained by adding a large force against residual compressed air.

A dispenser with an the air pump mechanism with no air hole for residual compressed air has been published in U.S. Pat. No. 3,955,720 (issued on May 11, 1976 to D. C. Malone). According to the Malone patent, a movable stem is installed in the inside of the piston and the stem is moved with the piston during pump operation. The tip of the stem keeps watertight the pressure chamber formed between a couple of valves by being in contact with the tubular sleeve installed in the inside of the piston. Compressed air remaining in the pressure chamber is released into the atmosphere through a clearance between the stem and sleeve, releasing the seal between them by moving the stem outwards independently of the piston and parting it from the sleeve. As mentioned above, according to the Malone patent, the dispenser has no air hole and it is not necessary to close an air hole; thus, pump operation is not complicated. Compressed air remaining in the pressure chamber can be easily released into the atmosphere. Furthermore, compressed air in the container can be released into the atmosphere by moving the stem inwards in the container independently of the piston, parting it from the sleeve, contacting it with the pressure accumulating valve of the couple of valves, and opening the pressure accumulating valve. However, since watertightness of the pressure chamber is accomplished by contacting the stem movable independently of the piston with the tubular sleeve fixed to the piston, the stem must be formed and arranged in accurate dimensions against the sleeve. In other words, the stem needs high accuracy in manufacturing and assembly.

SUMMARY OF THE INVENTION

It is therefore an object of this invention to provide a dispenser with an air pump mechanism which does not require high accuracy of the stem in manufacturing and assembly.

To accomplish this purpose, the dispenser with the air pump mechanism according to this invention comprises an air suction valve which includes an axially flexible valve body, and which is installed at the internal end of the piston for allowing air flow only to the pressure chamber formed between the cylinder and the piston. The dispenser further comprises a release means which includes an elastic piece having axially flexible elasticity and which is installed to the bottom of the piston, and a stem member fixed at one end to the bottom of the elastic piece and extending at the other end into the piston. The stem member has a pushing part to release the air suction valve by contacting the valve body of the air suction valve when the elastic piece is moved to the air suction valve. After accumulating pressure, therefore, compressed air remaining in the pressure chamber can be released into the atmosphere by pushing the bottom of the elastic piece in the pushing direction of the piston. Consequently, the pushing operation of the piston to the locking position can be easily carried out without resisting forces. In such a construction, it is not necessary to perform the pumping operation by closing an air hole as in a conventional method, and not only is the pumping operation done smoothly, but also the locking of the piston can be easily carried out. The stem member as the release means is used only for releasing the air suction valve and does not contribute at all to maintaining the watertightness of the air suction valve. Namely, the stem member is sufficient to release watertightness by contacting the valve body of the air suction valve when the elastic piece is moved toward the air suction valve. Therefore, it needs no manufacturing and assembling accuracy.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENT

Figure 1:
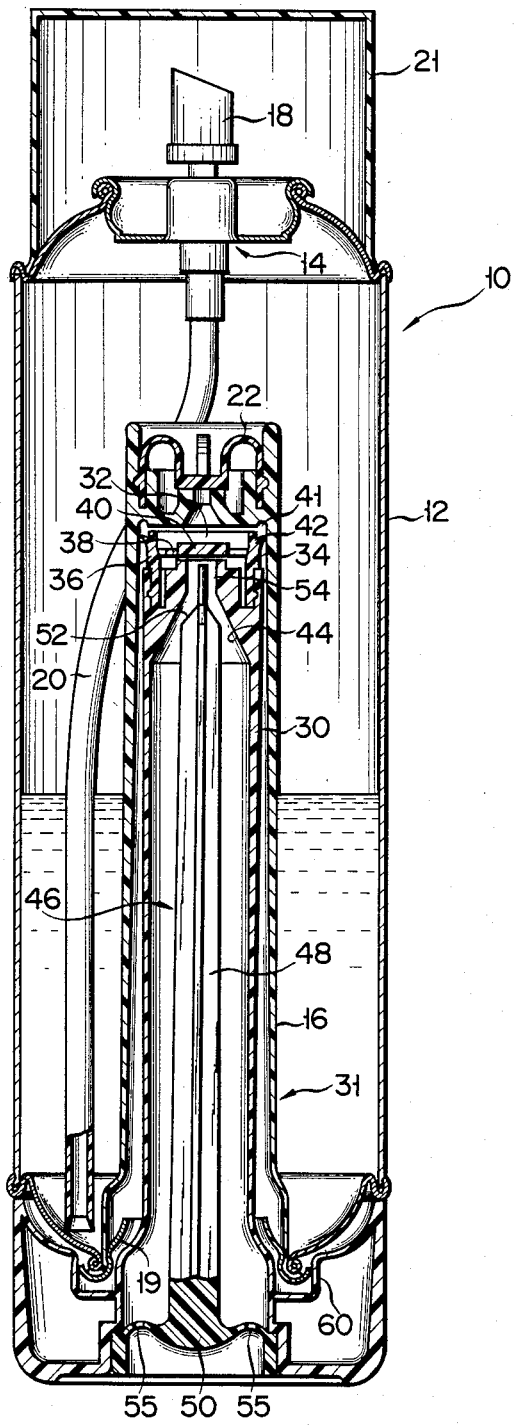
FIG. 1 is a longitudinal sectional view of a dispenser with an air pump mechanism according to the invention.

As shown in FIG. 1, a dispenser 10 with an air pump mechanism comprises a valve housing 14 attached to the top of a metallic container 12 and a cylinder 16 attached to the bottom of the container. The valve housing 14 contains internally a conventional spraying valve (not shown), and the valve will be released by pushing downwards a push button 18 which is attached at the top of the valve housing 14, the push button 18 being also used for a nozzle. A suction tube 20, through which fluid to be sprayed, which is contained in the container 12, passes to the spraying valve, is attached at the bottom of the valve housing 14. Therefore, by pushing the push button 18 downwards, the internal part of the container 12 will be opened to the atmosphere through the spraying valve, and this allows spraying. A cover housing 21 is detachably attached so as to cover the push button 18 at the top of the container 12.

Figure 2:
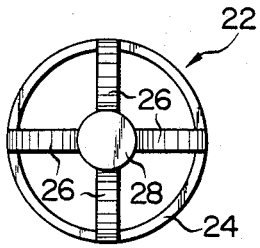
FIG. 2 is a plan view of the pressure accumulating valve.
Figure 3:
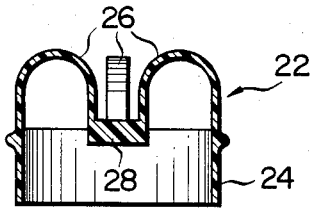
FIG. 3 is a longitudinal sectional view of the pressure accumulating valve.

The cylinder 16 is fitted with a tightening ring 19 to the curl edge at the bottom of the container 12 and is extended into the container. The cylinder 16 includes a pressure accumulating valve 22 at the internal end. The pressure accumulating valve 22 is a one-way valve which allows air flow only into the internal part of the container 12. As shown in FIGS. 2 and 3, the valve 22 has an axially flexible valve body 28 which is connected to a body 24 through four flexible pieces 26. Attachment of the cylinder 16 to the container 12 may be by screw engagement instead of being fitted. In this case, supply of the fluid into the container 12 may be easily carried out.

Figure 4:
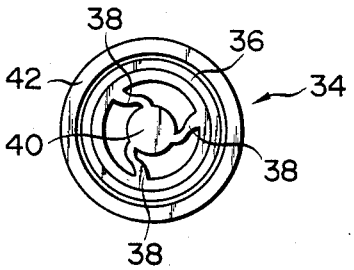
FIG. 4 is a plan view of the air suction valve.
Figure 5:
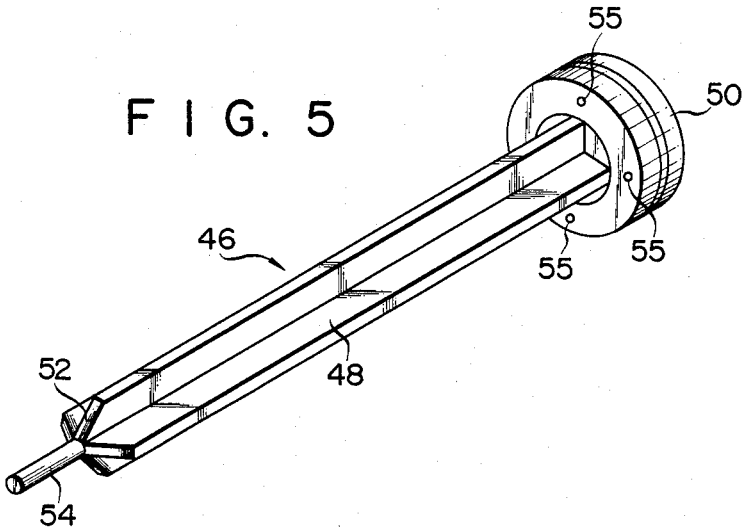
FIG. 5 is a perspective view of the release means.

As shown in FIG. 1, the cylinder 16 contains a hollow piston 30 which can move freely along the internal surface of the cylinder. An air pump mechanism 31 comprises the cylinder 16 and the piston 30. At the internal end, the piston 30 includes an air suction valve 34 which is a one-way valve allowing air flow into a pressure chamber 32 formed by the cylinder 16 and the piston. The air suction valve 34, as shown in FIG. 4, includes a valve body 40 which is axially flexible and is connected with three flexible pieces 38 to a body 36, and a skirt-like seal piece 42 formed on the periphery of the body 36. As shown in FIG. 1, the valve body 40 is installed at the location a little apart from the upper end of the piston 30 serving as a valve seat and prevents chattering of the valve body during the drawing stroke of the piston. It is a matter of course that the valve 34 will be closed by the valve body 40 being pushed and contacting the upper end of the piston by compressed air generated in the pressure chamber 32 during the pushing stroke of the piston 30. The piston 30 has a stopper, the inclined surface 44 for example, in its internal part, and the inclined surface 44 is, as described later, formed so as to be able to contact the shoulder 52 of the stem member 48. The stopper 44 may be axially moved and located at the center or outer end of the piston instead of at the internal end of the piston as shown in FIG. 1. The dispenser 10 further comprises a release means 46. As shown in FIG. 5, the release means 46 includes an elastic piece 50 having axially flexible elasticity such as the cylindrical part with bottom and a stem member 48 which has a cross-shaped section and is attached to the bottom of the cylindrical part 50 at its one end. The stem member 48 has an inclined shoulder 52 at the internal end in an adjacent position, and also has the pushing part, such as a cylindrical part 54, at the internal end, and the shoulder 52 is formed so as to be able to contact the inclined surface 44 of the piston 30, and the cylindrical part 54 is formed so as to be able to push the valve body 40 of the air suction valve 34.

The cylindrical part 50 with bottom comprises a plurality of air-inlet holes 55 for instance, four, and is, as shown in FIG. 1, fitted with the bottom of the cylinder 30. The stem member 48 attached to the cylindrical part 50 extends into the piston 30, pushing the bottom of the cylindrical part 50, the stem member 48 is raised up to contact the cylindrical part 54 with the valve body 40, and the valve body is pushed upwards. Upward movement of the stem member 48 is limited by contacting the shoulder 52 with the inclined surface 44.

On the other hand, the piston 30 will be joined as loading and unloading can be carried out freely by joining the annular joint 60 directly or indirectly to the curl edge of the container 12 with the tightening ring 19. Needless to say, the means to lock the piston 30 to the container 12 during spraying operation of the dispenser 10 are not limited to the above-mentioned construction using the curl edge, and other various constructions, for example a construction to use a joining groove and a joining projection etc, will be available.

The dispenser 10 constructed as mentioned above is operated in the following manner.

First, removing the joint between the annular joint 60 of the piston and the curl edge of the container, the piston 30 will be reciprocated in the cylinder 16. At this time the release means 46 will move together with the piston 30, and the air suction valve 34 will not be released. The drawing stroke of the piston 30 will increase the inner volume of the pressure chamber 32 and pressure will become negative in the pressure chamber. For that reason, the valve body 40 will be moved toward the pressure chamber 32, and the air suction valve 34 will be released and the skirt-like seal piece 42 will be deformed simultaneously. Air in the cylinder 16 and air flowed into the piston 30 through air-inlet holes 55 will flow into the pressure chamber 32 through the skirt-like seal piece 42 and the valve body 40. After that, the pushing stroke of the piston 30 will compress air in the pressure chamber 32 and the air will flow into the container 12 through the pressure accumulating valve 22 to be stored at high pressure. Repetition of the above reciprocating operation of the piston 30 will increase pressure of accumulated air in the container 12. As accumulation of pressure proceeds, compressed air in the container 12 will act as a resisting force against the piston 30, and the reciprocating motion of the piston will become dull. After the compressed air is fully accumulated, in order for the piston 30 to be pushed into its locked position, a large force is required because the pressure of compressed air remaining in the pressure chamber 32 acts as a resisting force against the piston. Then, in FIG. 1, the bottom of the cylindrical part 50 of the release means 46 is pushed upwards. By this operation, the stem member 48 will go up, contacting the cylindrical part 54 with the valve body 40, pushing the valve body upwards to be apart from the valve seat 41, and the air suction valve 34 will be released. For this reason, compressed air remaining in the pressure chamber 32 will flow into the piston 30 and will then be released into the atmosphere through the air-inlet holes 55. The resisting force acting on the piston 30 is, therefore, removed, and the piston can be easily pushed into the locked position.

After locking the piston 30, if the push button 18 is lowered, the spraying valve (not shown) will be opened and fluid pushed by compressed air accumulated in the container 12 will go up through the suction tube 20 and will be continually sprayed outwards through the nozzle (not shown).

In this invention, as mentioned above, the stem member 48 does not contribute at all to watertightness maintaining of the air suction valve 34. The stem member 48 only acts to release the watertightness by contacting the valve body 36 of the air suction valve 34 when the elastic piece 50 is moved toward the air suction valve 34. Since the travelling length of the elastic piece 50 can be set to a sufficient length, the stem member 48 does not require accuracy in dimensions and assembly. Further, the dispenser may be embodied as a foamer by setting a barrier in the fluid pass instead of the spraying valve used in the above example.

What is claimed is:

1. A dispenser with an air pump mechanism for dispensing liquid in a container by utilizing compressed air accumulated previously in the container through a pressure accumulating valve attached to an internal end of a cylinder by sliding a piston in the cylinder extended into the container, said piston having an internal end and a bottom end, and a pressure chamber being formed between said piston and said cylinder, the dispenser comprising:

an air suction valve including an axially flexible valve body, said air suction valve being attached to said internal end of said piston for allowing air flow only into said pressure chamber formed between the piston and the cylinder; and a release means including an elastic piece which has axially flexible elasticity and which is attached to the bottom of said piston, and a stem member having one end thereof fixed to the bottom of the elastic piece and another end extending into the piston, said stem member having a pushing part at said another end to release the air suction valve apart from a valve seat by contacting said valve body when said elastic piece moves to said air suction valve;

said air suction valve including said axially flexible valve body, a deformable skirt-like seal piece formed around the periphery of said valve body, and a plurality of flexible pieces coupling said valve body to said skirt-like seal piece, said axially flexible valve body being adapted to contact said valve seat in a watertight manner, and wherein a deformation of said skirt-like seat piece permits air flow into said pressure chamber.

2. The dispenser of claim 1, wherein said valve body of said air suction valve is located spaced apart from said valve seat when in an inoperative position.

3. The dispenser of claim 1, wherein said plurality of flexible pieces are inclined to a radial direction between said valve body and skirt-like seal piece.

4. The dispenser of claim 1 or 2, wherein said piston has a stopper extending radially inwards; and said stem member has a shoulder to limit axial movement of said stem member by contacting which said stopper.

5. The dispenser of claim 1 or 2, wherein said valve body is a substantially central valve body, and wherein said skirt-like seal piece includes a ring-shaped member having a seal piece formed on the periphery of said ring-shaped member, said plurality of flexible pieces coupling said valve body to said ring-shaped member.

6. The dispenser of claim 5, wherein said plurality of flexible pieces are inclined to the radial direction between said valve body and said ring-shaped member.

* * * * *